US005630581A

United States Patent [19]

Rodesch

[11] Patent Number: 5,630,581

[45] Date of Patent: May 20, 1997

[54] APPARATUS FOR DISPENSING LIGHTWEIGHT SHEET-STYLE ARTICLES FROM A STACKED SUPPLY OF ARTICLES

[75] Inventor: Gregory Rodesch, Oceanside, Calif.

[73] Assignee: Rodesch Associates, Inc., Escondido, Calif.

[21] Appl. No.: 583,606

[22] Filed: Jan. 5, 1996

[51] Int. Cl.[6] ..... B65H 3/30

[52] U.S. Cl. ..... 271/23; 271/902; 221/39; 221/40; 221/43; 221/41

[58] Field of Search ..... 221/39, 40, 41, 221/42, 43; 271/19, 21, 23, 902

[56] References Cited

U.S. PATENT DOCUMENTS

| | | | |
|---|---|---|---|
| 715,764 | 12/1902 | Dick . | |
| 2,280,964 | 4/1942 | Mixer . | |
| 3,126,122 | 3/1964 | Sacte | 221/41 |
| 3,372,923 | 3/1968 | Watson et al. . | |
| 3,425,685 | 2/1969 | Liva . | |
| 3,466,030 | 9/1969 | Swanson . | |
| 3,503,603 | 3/1970 | Dvorak . | |
| 3,608,891 | 9/1971 | Hannon . | |
| 3,734,488 | 5/1973 | Hannon et al. . | |
| 3,761,079 | 9/1973 | Azure . | |
| 3,777,929 | 12/1973 | Hannon et al. . | |
| 3,981,493 | 9/1976 | Klappenecker et al. . | |
| 4,157,692 | 6/1979 | Brocklehurst et al. . | |
| 4,277,059 | 7/1981 | Dunning | 271/23 |
| 4,372,549 | 2/1983 | Stiernspetz . | |
| 4,492,371 | 1/1985 | Kan et al. . | |
| 5,111,759 | 5/1992 | Hiramatsu et al. . | |
| 5,181,708 | 1/1993 | Ruch . | |
| 5,362,037 | 11/1994 | van der Werff et al. . | |
| 5,393,045 | 2/1995 | Fujimoto . | |
| 5,415,387 | 5/1995 | Suzuki . | |
| 5,445,371 | 8/1995 | Marzullo et al. . | |

FOREIGN PATENT DOCUMENTS

| | | | |
|---|---|---|---|
| 162802 | 1/1904 | Germany | 221/39 |

*Primary Examiner*—H. Grant Skaggs
*Attorney, Agent, or Firm*—Lockwood, Alex, Fitzgibbon & Cummings

[57] ABSTRACT

An apparatus for dispensing individual thin sheet-like articles from a supply stack of articles includes a supply magazine, and a base closing off the supply magazine. The base includes a dispensing assembly which includes a reciprocatably driven roller upon which the article supply stack rests on. Two openings are located on opposite sides of the roller so that the bottommost article may be bent into one opening as the roller is driven in one direction to free it from the supply stack. Rotation of the roller in the opposite direction urges the bottommost article against a curved deflector plate out of the second opening.

11 Claims, 5 Drawing Sheets

118
160
158
7A
7B
135
134
155
140
142
128
136
164
162
197
174
180
168
178
176
LB
6
5
V
H
$C_B$
144
145
152
154
150
202
206
148
200
204

APPARATUS FOR DISPENSING LIGHTWEIGHT SHEET-STYLE ARTICLES FROM A STACKED SUPPLY OF ARTICLES

BACKGROUND OF THE INVENTION

The present invention relates generally to an apparatus for dispensing lightweight articles from a stacked supply of such articles and more particularly to a dispensing apparatus for dispensing, in serial order, individual lightweight paper articles, such as lottery tickets.

Previous devices for the dispensing of a single article from a stacked supply of the articles are known in the art. Such devices find their application in the computer arts where they are used to feed single sheets of paper to a printer, as well as in the automated teller machine art where currency banknotes are dispensed in serial order from a supply of banknotes. An example of the latter application is disclosed in U.S. Pat. No. 4,372,549, issued Feb. 8, 1983. The apparatus disclosed in the '549 patent is complicated because a particularly configured banknote supply magazine and a curved roller having a configuration complementary to that of the supply magazine. The stated purpose behind these configurations is to increase the rigidity of single banknotes drawn from the bottom of a supply stack of banknotes. Such a device, although perhaps appropriate for the dispensing of brand new, crisp banknotes is believed to be incapable of dispensing lightweight, fragile paper articles from a stacked supply of such articles. Additionally, there is no mechanism disclosed in this patent by which access to the dispensing opening of the dispensing apparatus may be substantially blocked to prevent access from the exterior to the dispensing opening.

The present invention is directed to an apparatus of simpler structure than that disclosed in the aforementioned '549 patent, which apparatus may be used for dispensing single, lightweight paper articles from a stacked supply of such articles. The invention finds particular utility in the dispensing of paper lottery tickets.

Lotteries are growing in popularity and are used extensively in foreign countries on a national basis. One such example is the Brazilian lottery. Brazilian lottery tickets comprise an assembly of soft paper sheets having end dimensions of approximately 8 by 4 inches and glued together at the edges. Such tickets are typically formed by folding a thin paper blank of about 8½ by 11 inches multiple times to create a number of folds. The edges of the folded paper are often glued together to maintain its shape. Not all of the folds are equal in width which results in an end product of varying thickness. These lottery tickets have heretofore not been available through vending machines because they are thin, lightweight and relatively fragile.

The present invention is therefore directed to an apparatus for use in dispensing sheet-like articles from a stacked supply of such articles and is particularly useful for the dispensing in serial order of thin, lightweight and fragile articles, such as the aforementioned Brazilian paper lottery tickets, in a reliable manner. Such an apparatus may be conveniently mounted in a vending machine to thereby permit automated purchases of such articles by users.

SUMMARY OF THE INVENTION

The present invention provides an article dispensing apparatus with the aforementioned advantages. In an article dispensing apparatus constructed in accordance with the principles of the present invention, a base member is provided which is adapted to receive a supply magazine in which soft planar articles, such as paper lottery tickets are held in a vertical stack. The base member includes a driven dispensing assembly which includes a dispensing roller mounted on the base member and positioned intermediate the two opposing endwalls of the article supply magazine. The roller is operated by a reversible drive means, such as a stepper motor, which initially drives the bottommost article of the supply stack in a first direction against an endwall of the supply magazine in order to cause the article to bend and then the drive roller is reversed in its rotation to a second direction, opposite that of the first direction, in order to drive the bottommost article out of the apparatus.

In order to facilitate the operation of the roller, a preferred embodiment of the present invention includes two slots, or openings, disposed in the base member on opposite sides of the roller. The first slot provides an opening for the bottommost article to bend in as it is moved by the roller along the bottom of the article supply stack, while the other slot provides an opening for the article to be driven through when the roller direction is reversed.

A deflector, or article guiding blade, is located proximate to the other slot in the preferred embodiment and utilizes a compound curve to present an article-contacting surface against which the leading edge of the article is driven when the roller reverses and is driven in a dispensing mode.

A locking mechanism is provided in an alternate embodiment of the invention which substantially closes off the dispensing opening of the apparatus in order to prevent access to the dispensing opening for security, but opens to permit the passage of an article out of the apparatus.

Accordingly, it is a general object of the present invention to provide an improved article dispensing apparatus for reliably dispensing in serial order individual thin and fragile planar paper articles from a stacked supply of such articles.

Another object of the present invention to provide an article dispensing apparatus, particularly suitable for dispensing soft, thin paper lottery tickets individually in serial order from a stacked supply by moving the individual lottery tickets in two different directions in order to first free the tickets from a support surface and then to drive the tickets through a dispensing opening of the apparatus.

It is yet another object of the present invention to provide an article dispensing apparatus for dispensing fragile sheet-like paper articles by first bending the articles to retract the leading edge of the article past a support surface into alignment with a dispensing slot and subsequently advancing the leading edge into contact with the deflection blade to urge the article out of the dispenser.

It is still a further object of the present invention to provide a deflection blade for use in an article dispensing apparatus wherein the blade has a compound curved profile to facilitate deflecting articles driven from the bottom of the stacked supply of articles.

It is a yet another object of the present invention to provide an roller-driven article dispensing apparatus with a means for preventing access to the dispensing opening of the apparatus yet permitting the dispensing of sheet-like articles from the apparatus.

These and other objects, features and advantages of the present invention will be apparent through a reading of the following detailed description, taken in conjunction with accompanying drawings, wherein like reference numerals refer to like parts.

BRIEF DESCRIPTION OF THE DRAWINGS

In the course of the description, reference will be made to the attached drawings in which.

DETAILED DESCRIPTION OF THE PREFERRED EMBODIMENTS

Figure 1:
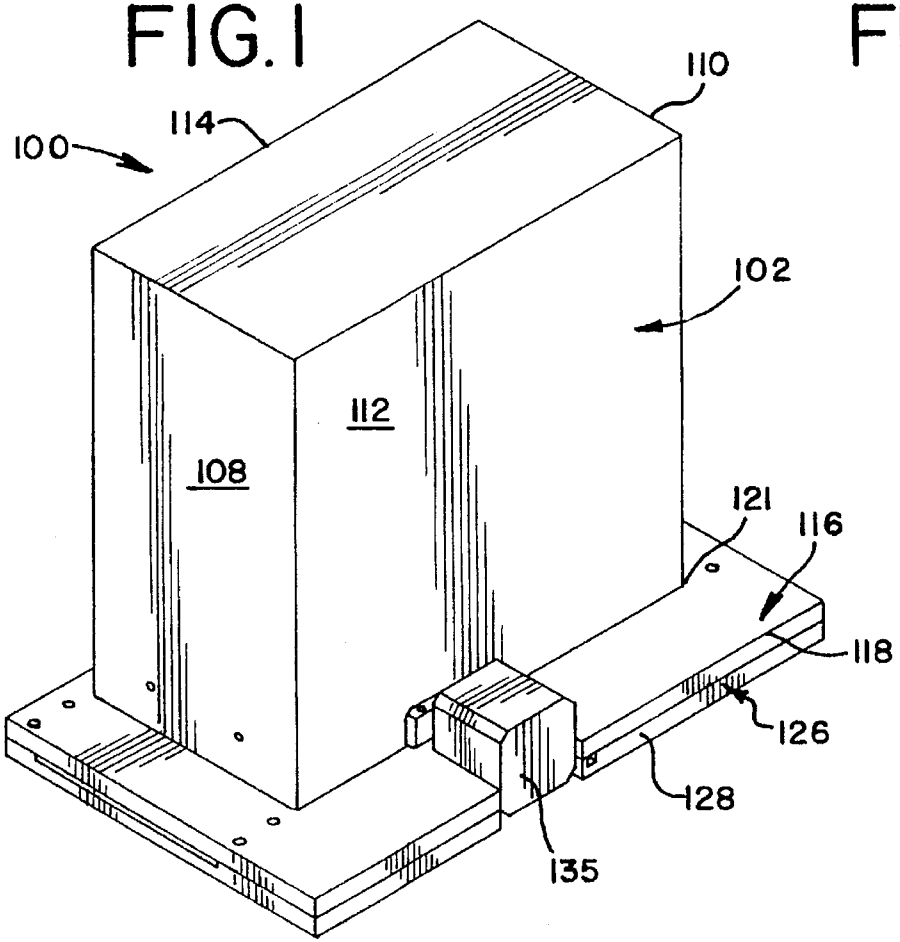
FIG. 1 is a perspective view of a preferred embodiment of an article-dispensing apparatus constructed in accordance with the principles of the present invention which is particularly suitable for the serial dispensing of lightweight paper lottery tickets.

FIG. 1 illustrates one preferred embodiment of an article dispensing apparatus, generally designated 100 and constructed in accordance with the principles of the present invention. The embodiment illustrated is particularly suitable for dispensing thin paper lottery tickets from a stock of tickets held within a supply magazine 102.

Figure 2:
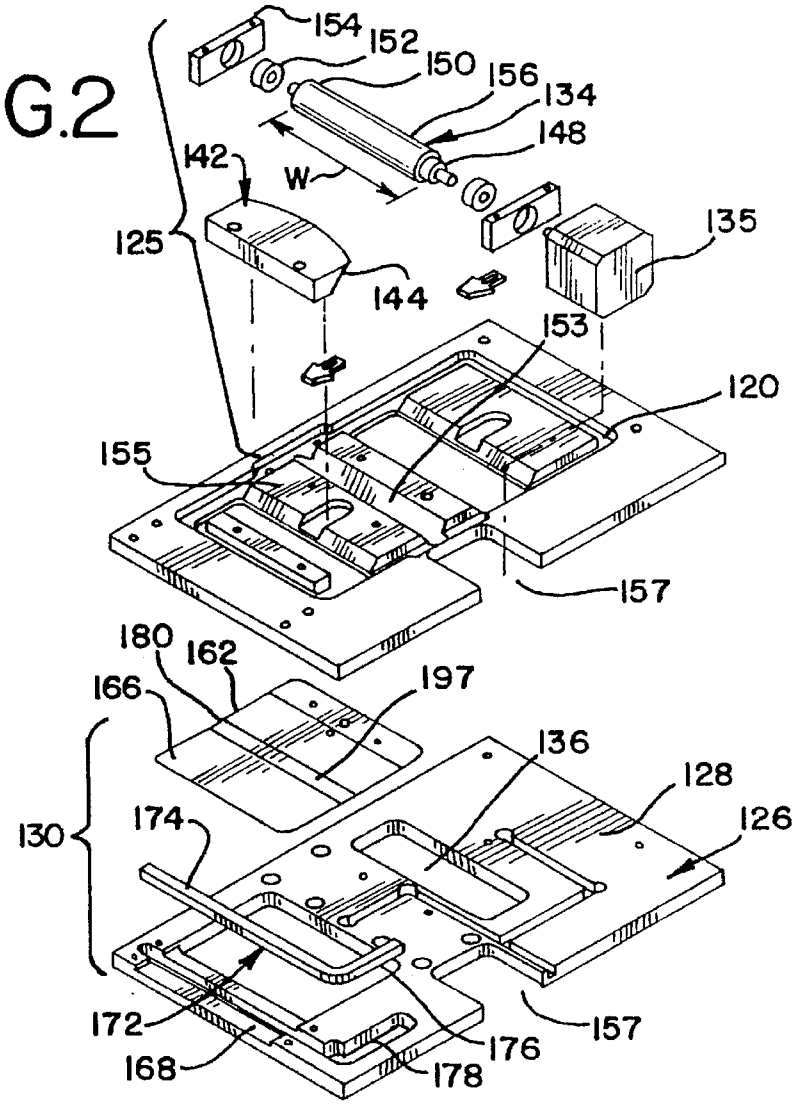
FIG. 2 is an exploded view of the apparatus of FIG. 1 with its supply magazine removed illustrating the internal components of the apparatus.

The supply magazine 102 is illustrated as a vertical magazine which holds a supply of planar articles 104 in a stack 106 (FIG. 9). The magazine 102 encloses the stack 106 and has two opposing endwalls 108, 110 which are interconnected by a pair of sidewalls 112, 114. The magazine 102 is supported on a base 116, illustrated as a plate 118 having a recess 120 which receives the bottom 121 of the magazine 102 and which supports a dispensing assembly 125. A support member 126 is illustrated in FIGS. 1 and 2 as a support, or lower plate, 128 which supports a locking mechanism 130 (described in greater detail below) which prevents access to the dispensing assembly 125 from the exterior.

Turning now to FIG. 9, the general principles of operation of the dispensing apparatus 100, are illustrated. As seen in FIG. 9, an article dispensing means in the form of a cylindrical roller 134 is mounted on the base plate 118 intermediate between the opposing endwalls 108, 110 of the supply magazine 102. The articles 104 are planar in nature and are illustrated in the Figures as having a rectangular configuration. The articles 104 may include thin paper assemblies, such as the Brazilian lottery tickets mentioned above.

Rotation of the roller 134 clockwise by a suitable drive means such as a stepper motor 135, and as illustrated in FIGS. 9A–9L, the roller 134 urges the bottommost article 105 against the one endwall 110 of the supply magazine 102. In doing so, and partially due to the nature of the articles 104, the bottommost article 105 bends between the roller 134 and the endwall 110 at B. A first slot, or article bending opening, 136 is disposed on the right-hand side of the roller 134 as viewed in FIGS. 9A–9L and accommodates the bending of the article 105 by permitting the article to bend into the opening 136.

During this bending, the leading edge 138 of the article 105 (shown at the left of the article in FIGS. 9A–9L) is drawn across an article support surface 140 of a deflector 142, shown in the Figures as a curved blade 144. When the leading edge 138 of the article 105 is drawn past the deflector blade 144, the roller 134 reverses its rotation and rotates counterclockwise (FIGS. 9F–9L) to drive the article 105 forward (or leftward in the drawings). The leading edge 138 of the article 105 then contacts the deflector blade 144 which urges the article 105 down through a second slot 146 and out of the dispensing apparatus 100.

Figures 3, 4:
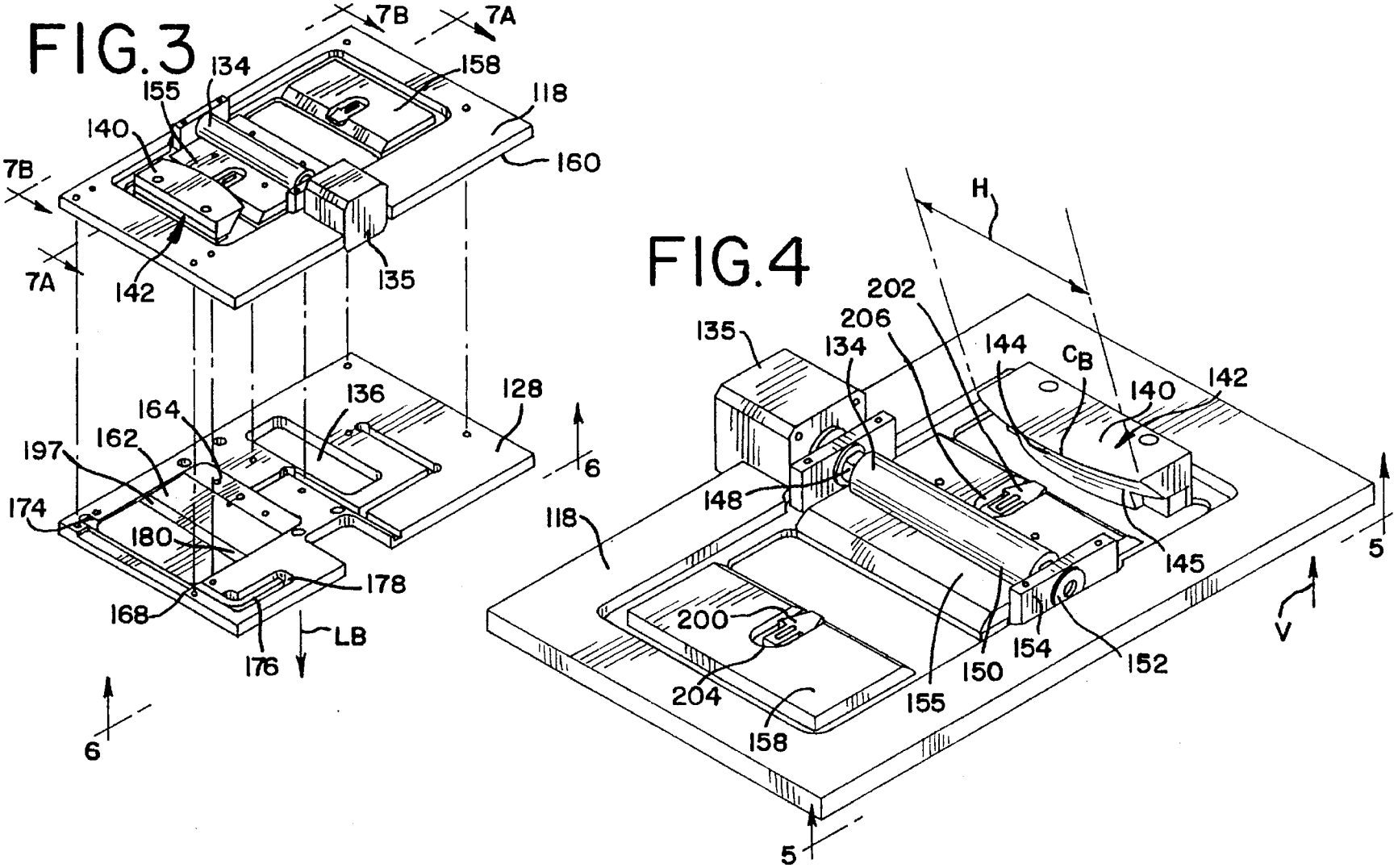
FIG. 3 is an exploded view of the apparatus of FIG. 1 showing the alignment of the dispensing assembly and dispensing opening closure assembly.
FIG. 4 is a perspective view of the dispensing assembly of the apparatus of FIG. 1.

Turning now to FIGS. 2 and 3, the details of the dispensing assembly 125 are specifically illustrated. In contrast to the apparatus disclosed in the aforementioned U.S. Pat. No. 4,372,549, the roller 134 of the present invention is generally cylindrical in shape and has a substantially circular cross-section extending for the entire width W of the roller 134 which contacts the articles 104. Because the roller 134 is not specially configured as taught in the '549 patent, no specially configured magazine bottom is required for the apparatus 100. In fact, no magazine bottom need be used at all on the apparatus 100 of the invention, leading to a simpler and less expensive article dispensing apparatus. As explained in greater detail below, the article stack 106 is supported entirely on the major components which make up the dispenser assembly 125.

The dispenser assembly 125 includes a second slot, or dispensing opening, 146 disposed in both the base and lower plates 118, 128. Both the bending and the dispensing openings 136, 146 are located proximate to and opposite sides of the roller 134.

The roller 134 may include an inner shaft 148 with an exterior hollow cylindrical covering 150 which is preferably formed from a material with desirable surface friction characteristics, such as rubber. The roller shaft 148 is supported at its ends 151 in bearings 152 held within appropriately positioned mounting blocks 154. One of the shaft ends 151 may be directly connected to and driven by a stepper motor 135 supported within a recess 157 formed in the base plate 118. The base member 116 may include a transverse recess 153 formed in a roller support bed 155 which receives the lower portion of the roller 134 in its extent between the roller mount blocks 154.

Figure 7A:
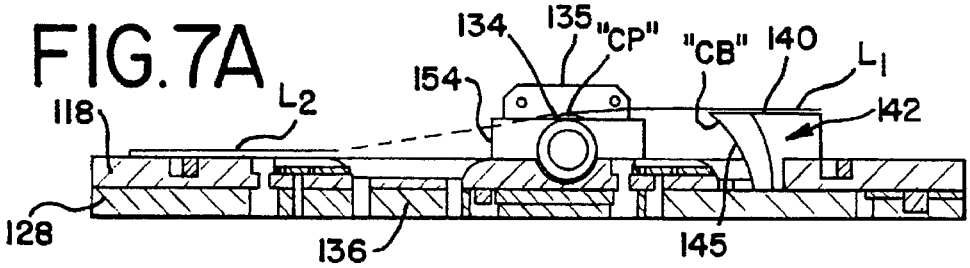
FIG. 7A is a sectional view of the article dispensing apparatus taken generally along lines 7A—7A of FIG. 3.
Figure 7B:
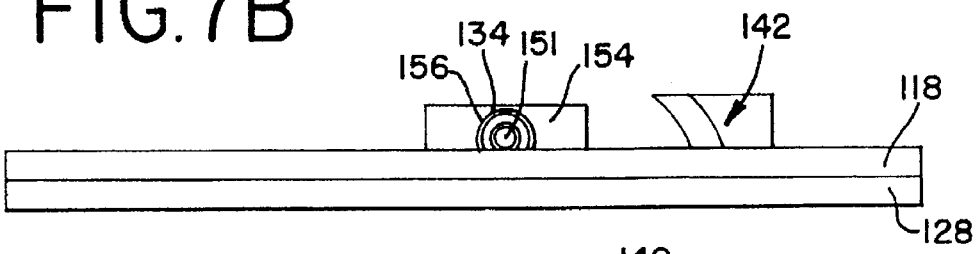
FIG. 7B is an elevational view of the article dispensing apparatus taken generally along the left edge thereof as reflected along lines 7B—7B of FIG. 3.

As shown schematically in FIGS. 9A–9L and specifically in FIGS. 7A & 7B, the outer surface 156 of the roller 134 is essentially cylindrical and, in order to take advantage of the configuration of the roller 134, the roller is preferably positioned on the base member 116 at an elevation such that the center peak, or tangent point CP, of the roller outer surface 156 lies approximately in a common plane with the deflector support surface 140. This plane is indicated in FIG. 7A at $L_1$.

The "forward" portion of the bottommost article 105, i.e., that portion of the article 105 extending between the roller 134 and the endwall 108 of the supply magazine 102 which lies nearest the dispensing opening 146, (and the rest of the articles 104 which make up the stack 106) are supported on these two surfaces CP and 140. The "rear" portion(s) of the article(s) 105 are generally supported in another plane $L_2$ at a different level from the first plane $L_1$, shown at the left of FIG. 7A, which occurs primarily on top of the article support bed 158. These two planes, in effect, cause the articles, and specifically for the bottommost article 105 to slight bend, or slant, intermediate the article ends. The articles 104 slant downwardly generally along the dotted line in FIG. 7A toward the rear endwall 110 of the supply magazine 102. This slant facilitates the bending of the articles 104 when the roller 134 rotates in its first, clockwise, direction and initially drives the article 105 into the bending opening 136 inasmuch as the bottommost article 105 is constrained on its top by the stack 106 of articles 104, on its sides by the sidewalls 112, 114 of the supply magazine 102 and at its trailing edge by the magazine endwall 110. Additionally, the slant ensures that when the ticket 105 is driven out of the apparatus 100, it does not drive up into the stack 106, but rather buckles, or bends, above the bending opening 136.

Figure 5:
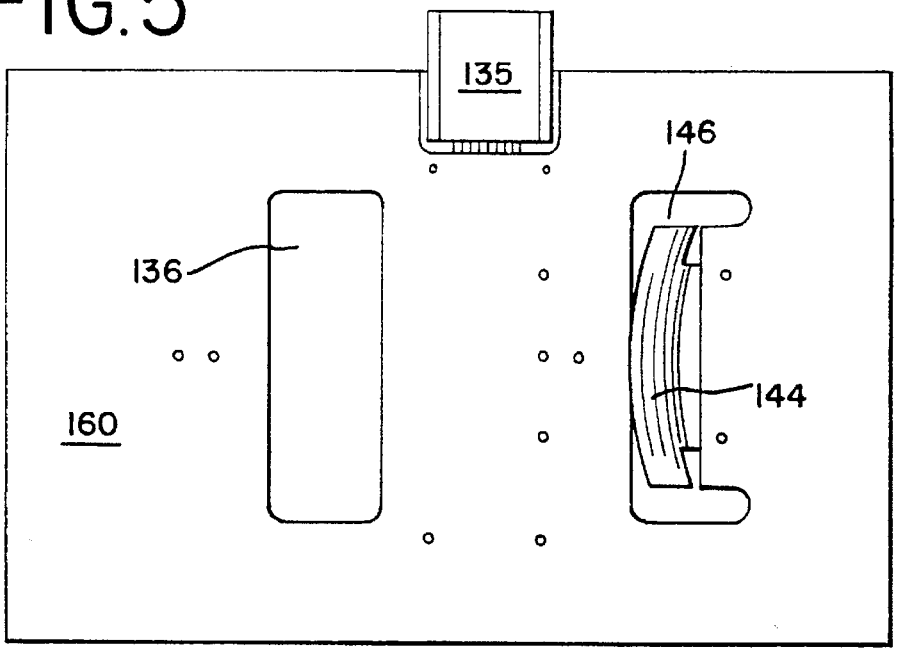
FIG. 5 is a plan view of the bottom of the dispensing assembly of FIG. 4 taken along lines 5—5 thereof.
Figure 6:
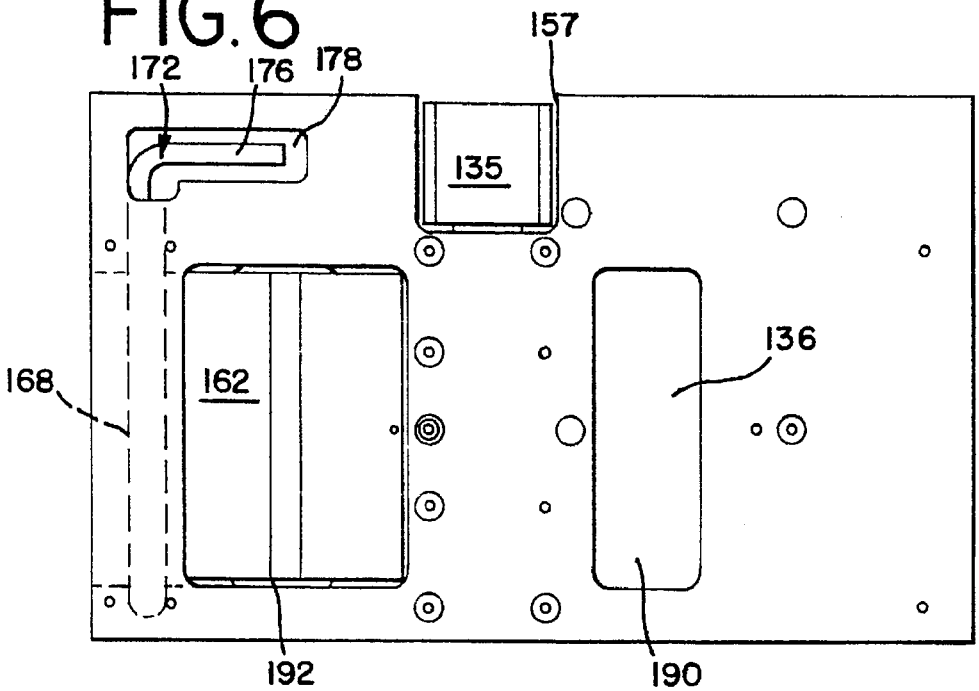
FIG. 6 is a plan view of the bottom of the support plate assembled together with the dispensing assembly taken generally along the lines 6—6 of FIG. 3.

With particular reference to FIGS. 4 and 5, it can be seen that the deflector 142 is enclosed within the supply magazine 102, above the base 116 of the apparatus 100 and has a blade portion 144 which generally opposes the roller 134 and the leading edges 138 of the bottommost articles 105 when they are drawn rearwardly by the roller 134 and advanced formally. Due to the thinness and fragility of the aforementioned Brazilian lottery tickets, as with other thin and fragile paper articles, the leading edges 138 of the articles 105 when advanced out of the apparatus 100 may crush, or otherwise crumple when driven against a flat, planar deflection surface as disclosed in U.S. Pat. No. 4,372,549. The present invention avoids this potential problem by providing a curved article-contacting surface 145 or profile to the deflector blade 144.

Figure 10:
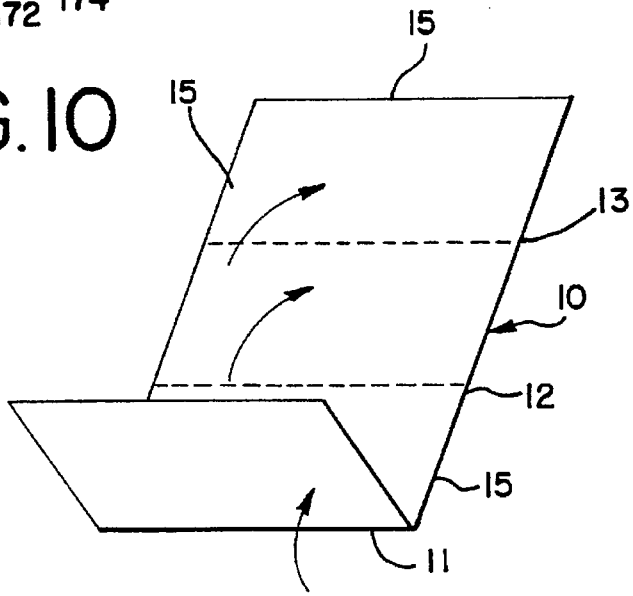
Figure 9A:
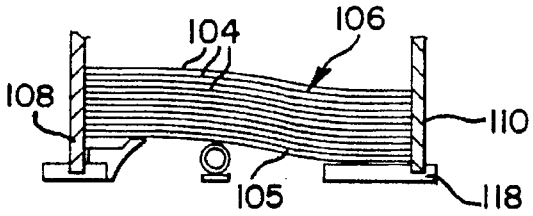
FIG. 9A–9L are a series of schematic sectional views illustrating the principles of operation of the apparatus of FIG. 2; and, FIG. 10 is a plan view of a paper blank illustrating the construction of a lottery ticket used in the apparatus of FIG. 1.
Figure 9B:
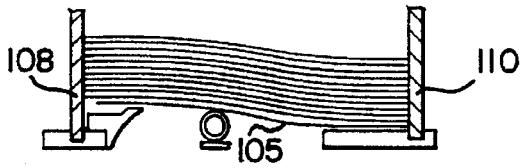
Figure 9C:
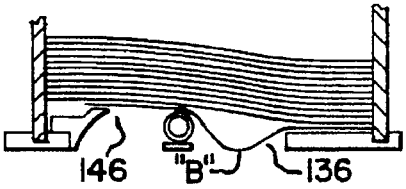
Figure 9D:
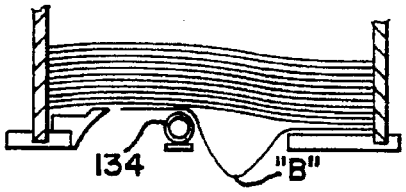
Figure 9E:
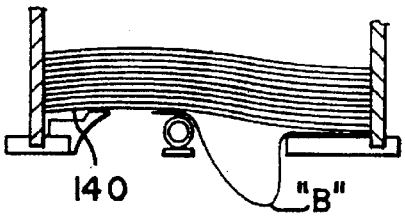
Figure 9F:
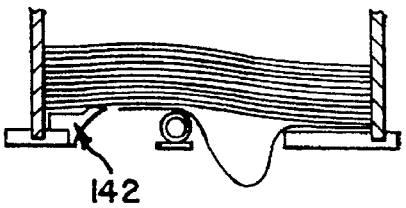
Figure 9G:
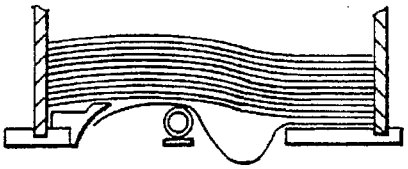
Figure 9H:
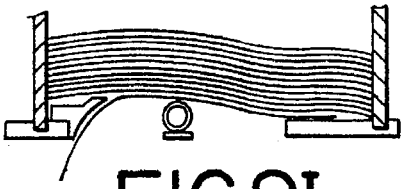
Figure 9I:
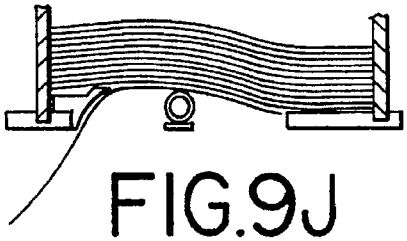
Figure 9J:
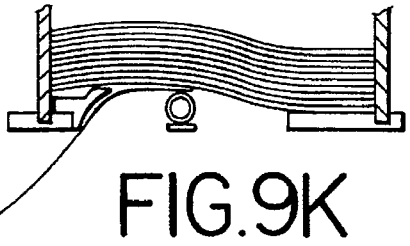
Figure 9K:
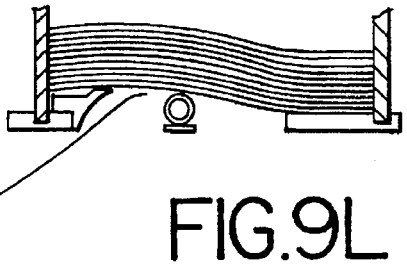
Figure 9L:
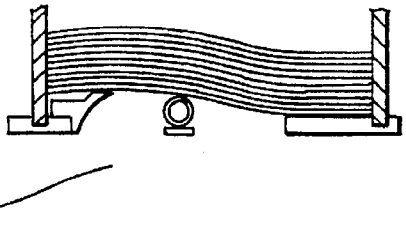

FIG. 10 illustrates a paper blank 10 which represents the manner in which Brazilian lottery tickets are formed. The blank 10 is folded upon itself along various foldlines 11—13 of varying widths, which results in a multilayer structure of varying thickness. The blank may be glued along its edges 15 to maintain its overall rectangular configuration.

As illustrated in the Figures, this deflection surface 145 is a compound curve. That is, the surface 145 of the blade 144 is curved in both the vertical direction V and the horizontal direction H. (FIG. 4.) Additionally, as seen best in FIGS. 4 and 5, the width of the deflector blade 144 is greater at its top than at its bottom. Furthermore, the deflector blade article contacting surface 145 takes on an overall arcuate profile extending rearwardly toward the roller 134 to form what may be considered as a "crown" to surface 145. The practical effect of this crowning is to project the center CB of the deflector blade 144 and its constituent contact surface 145 so that the leading edge 138 of an article 105 contacts the central portion of the blade 144 first. If the leading edge 138 of the article 105 is at all crumpled or wavy, this crown reduces further crumpling and also increases the ease with which the articles 104 are dispensed from the apparatus, despite their condition.

When used the apparatus 100 of the present invention is used in the lottery ticket application described above or for the dispensing of currency, a concern arises with respect to security of the dispensing apparatus. If the bottom face 160 of the base plate 118 served as the bottom of the apparatus 100, access to the dispensing opening 146 is readily available from the exterior leading to the possibility of intentional tampering with the apparatus 100 or jamming of the dispensing opening 146.

The present invention overcomes this problem by providing a locking mechanism 130 which effectively seals the dispensing opening 126, but selectively opens during driving of the article 105 out of the apparatus. The details of the locking mechanism 130 are best illustrated in FIGS. 2, 3 and 8A and 8B. The mechanism 130 includes a support member 126 having an support plate bending opening 190 which aligns with the bending opening 136 and a support plate dispensing opening 192 which aligns with the dispensing opening 146 of the base plate 118. A thin sheet metal seal, or flapper plate, 162 is supported over the support plate dispensing opening 192. The flapper plate 162 may be affixed to the base plate 118 such as by screws 164 and it preferably includes a front lip 166 which extends through the recess 168 of the support plate 128 which is aligned with the dispensing opening 126. Because the flapper plate 162 is supported at only one end, its other end, namely, its lip 166 is free to move up and down within the horizontal spacing 170 which occurs in the dispensing opening recess 168.

Figure 8A:
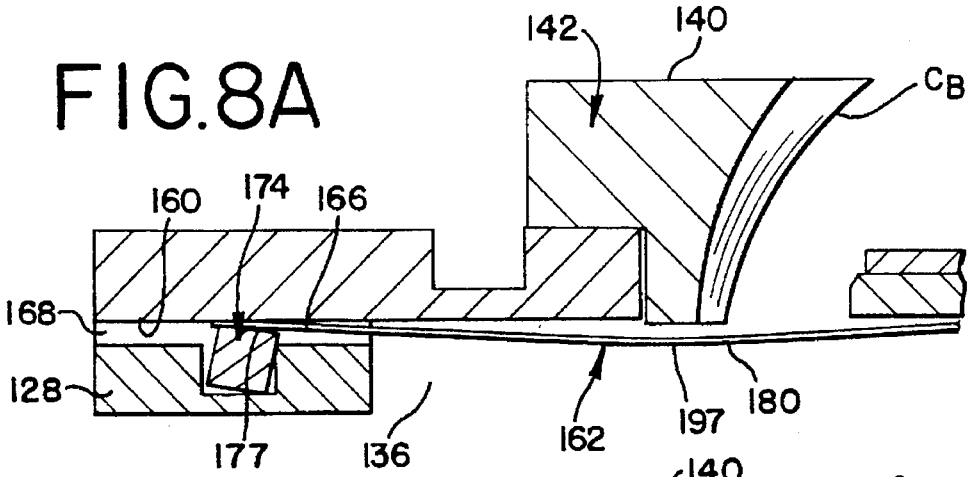
FIG. 8A is a schematic sectional view of the dispensing end of the apparatus of FIG. 2 showing the dispensing opening closure assembly in a closed position.
Figure 8B:
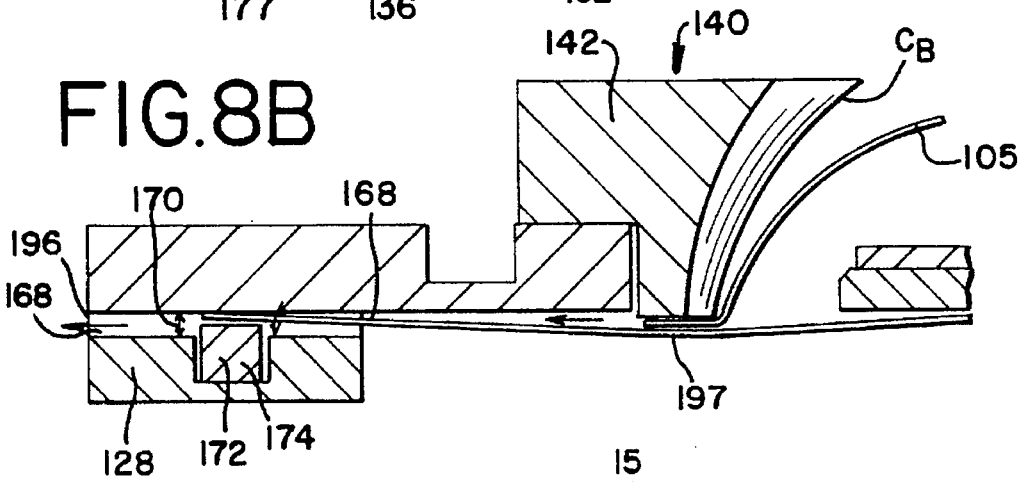
FIG. 8B is a schematic sectional view similar to FIG. 8A, but showing the dispensing opening closure assembly means in an open position.

In one important aspect of the present invention, the locking mechanism 130 includes an actuator 172 in the form of an L-shaped locking bar 174 which extends across the dispensing opening recess 168. (FIGS. 8A and 8B.) The actuator 172 has a lever portion 176 and a bearing portion 177. The bearing portion 177 extends across the recess 168 and bears against the flapper plate lip 166 (which extends above it) under the action of gravity on the lever portion 176, which is contained within an actuator opening 178 in the support plate 128 which permits the lever portion 176 to rotate slightly downwardly within the opening 178 as indicated by the arrow LB in FIG. 3.

The closure action of the locking mechanism is illustrated in FIGS. 8A and 8B where FIG. 8A illustrates a normal position, where the lever portion 176 of the locking bar 174 has rotated due to the force of gravity, when the apparatus 100 is activated and an article 105 is driven against the deflector 142, the leading edge 138 of the article 105 impinges upon the mid-section 180 of the flapper plate 162 and follows it out to the dispensing opening slot 196. Preferably, the flapper plate 162 is formed either with a curve or an interior depressed portion 197 at its mid-section 180 as illustrated in the Figures. The force of the article 105 being driven through the recess 168 is enough to overcome the rotational force of the lever portion 177 and the article 105 moves the flapper plate 162 down away from the bottom face 160 of the base plate 118 and forces the locking bar 164 into a horizontal position to thereby permit the article 105 to be dispensed through the dispensing opening slot 196. This locking mechanism, and particularly, the extension of both the dispensing openings 146, 192 of the base and support plates into the slot 196 readily permits the apparatus to be used in vending machine applications. The flapper plate 162 may also be formed flat from a resilient thin metal sheet.

The present invention may also include optoelectronic sensors 200, 202 disposed within recesses 204, 206 formed respectively within the article support bed 158 and the roller support bed 155. These sensors 200, 202 serve to provide a signal to the apparatus 100 and its stepper motor 135 to indicate that the article 105 is bending properly within the bending opening 136 in order to reverse the direction of rotation of the motor 135 as well as to indicate the passage of an article through the dispensing opening 146.

It will be appreciated that the present invention, as described above offers numerous benefits and advantages over the prior art dispensing apparatus. The apparatus 100 is suitable for use in vending machine type applications and is constructed as an overall single unitary assembly to facilitate replacement.

Although described in the above description with particular reference to the dispensing of lottery tickets, the present invention may be equally suitably used in the dispensing of currency as either change or a direct payment from a vending machine, automated teller machine or casino gambling machine, such as a slot machine, video gambling machine or the like.

It will be appreciated that the embodiments of the present invention which have been discussed are merely illustrative of some of the applications of this invention and that numerous modifications may be made by those skilled in the art without departing from the true spirit and scope of this invention.

I claim:

1. An article dispensing apparatus for dispensing, in serial order, individual articles from a stacked supply of articles, said articles comprising thin planar paper sheets and said apparatus comprising:

a supply magazine for receiving and storing a supply of said articles in the form of a stack, the magazine having opposing first and second endwalls, said magazine further having sidewalls extending between and interconnecting said endwalls to define an enclosure of said supply magazine which receives said stack of articles;

a base member, a roller mounted on the base member and adapted for rotation in two opposing directions, said base member having first and second slots disposed on opposite sides of the roller, said first slot providing a bending opening through which a portion of the bottommost article of said stack may be bent by rotation of said roller in a first direction, said second slot providing a dispensing opening through which said bottommost article may be dispensed by rotation of said roller in a second direction opposite that of said first direction;

said dispensing assembly further including a deflector disposed on said base member in the path of said bottommost article as it is driven by said roller in said second direction, said deflector including a curved article-contacting surface disposed proximate to and extending across at least a portion of said second opening, whereby, when said roller rotates in said second direction, a leading edge of the bottommost article contacts said article-contacting surface and is deflected into said dispensing opening and out of said supply magazine and dispensing assembly.

2. The article dispensing assembly as defined in claim 1, further including sensor means operatively associated with said first and second slots to determine the presence of an article in either of said first and second slots.

3. The article dispensing assembly as defined in claim 1, wherein said article-contacting surface includes a compound curve.

4. The article dispensing assembly as defined in claim 3, wherein said article-contacting surface has a decreasing width from top to bottom.

5. The article dispensing assembly as defined in claim 3, wherein said roller is driven by a stepper motor.

6. The article dispensing assembly as defined in claim 1, wherein said roller includes a generally cylindrical outer surface which at least partially supports said stack of articles in said supply magazine.

7. The article dispensing assembly as defined in claim 1, wherein said deflector includes a support surface aligned with a cylindrical outer surface of said roller to define a first article support plane, for said stacked articles.

8. The article dispensing assembly as defined in claim 1, further including selectively actuable means for sealing said dispensing opening to prevent access thereto from exterior of said apparatus.

9. The article dispensing assembly as defined in claim 8, wherein said sealing means includes dispensing slot disposed in said base member proximate to said dispensing opening, the dispensing slot defining one extension of said dispensing opening, a closure plate extending into a portion of said dispensing slot and sealing over said base member dispensing opening to thereby establish a barrier which restricts access to said dispensing opening from exterior said apparatus, an actuator for biasing said closure plate into a closed position against said base member to thereby close off said dispensing opening, said actuator partially releasing said closure plate from said closure position and permitting passage of an article driven from said stack of articles in response to impingement of said article upon said sealing means.

10. The article dispensing assembly as defined in claim 9, wherein said actuator includes an angled member having a bearing portion and a lever portion, the bearing portion being in contact with said closure plate in said closed position.

11. The article dispensing assembly as defined in claim 10, wherein said lever portion is received within a lever opening of said base member, said lever portion being unsupported within said lever opening so as to permit said lever portion to rotate under the force of gravity and thereby apply a closure force to said actuator.

* * * * *